US006524658B2

(12) United States Patent
Murofushi et al.

(10) Patent No.: US 6,524,658 B2
(45) Date of Patent: Feb. 25, 2003

(54) PROCESS FOR FABRICATION OF METAL-CARBON FIBER MATRIX COMPOSITE MATERIAL

(75) Inventors: Eiji Murofushi, Shizuoka (JP); Takeshi Kamata, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/682,088

(22) Filed: Jul. 18, 2001

(65) Prior Publication Data

US 2002/0064602 A1 May 30, 2002

(30) Foreign Application Priority Data

Jul. 19, 2000 (JP) ..... 2000-218996

(51) Int. Cl.[7] ..... B05D 1/18; B05D 3/10

(52) U.S. Cl. ..... 427/431; 427/299; 427/323; 427/434.2; 427/434.6; 427/434.7

(58) Field of Search ..... 427/430.1, 431, 427/434.2, 434.6, 434.7, 299, 437, 323

(56) References Cited

U.S. PATENT DOCUMENTS

| | | | | |
|---|---|---|---|---|
| 4,376,803 A | * | 3/1983 | Katzman | 427/226 |
| 4,681,151 A | * | 7/1987 | Koya et al. | 164/110 |
| 4,681,538 A | * | 7/1987 | DeLuca et al. | 433/9 |
| 5,736,199 A | * | 4/1998 | Blucher | 118/400 |

* cited by examiner

*Primary Examiner*—Michael Barr
(74) *Attorney, Agent, or Firm*—Sughrue Mion, PLLC

(57) ABSTRACT

A process for the preparation of a metal-carbon fiber matrix composite material which comprises removing a sizing agent from a bundle of carbon fibers, dipping the bundle of carbon fibers sequentially in an alkoxide solution and an alcohol, and then infiltrating the bundle of carbon fibers with a molten metal.

2 Claims, 1 Drawing Sheet

FIGURE
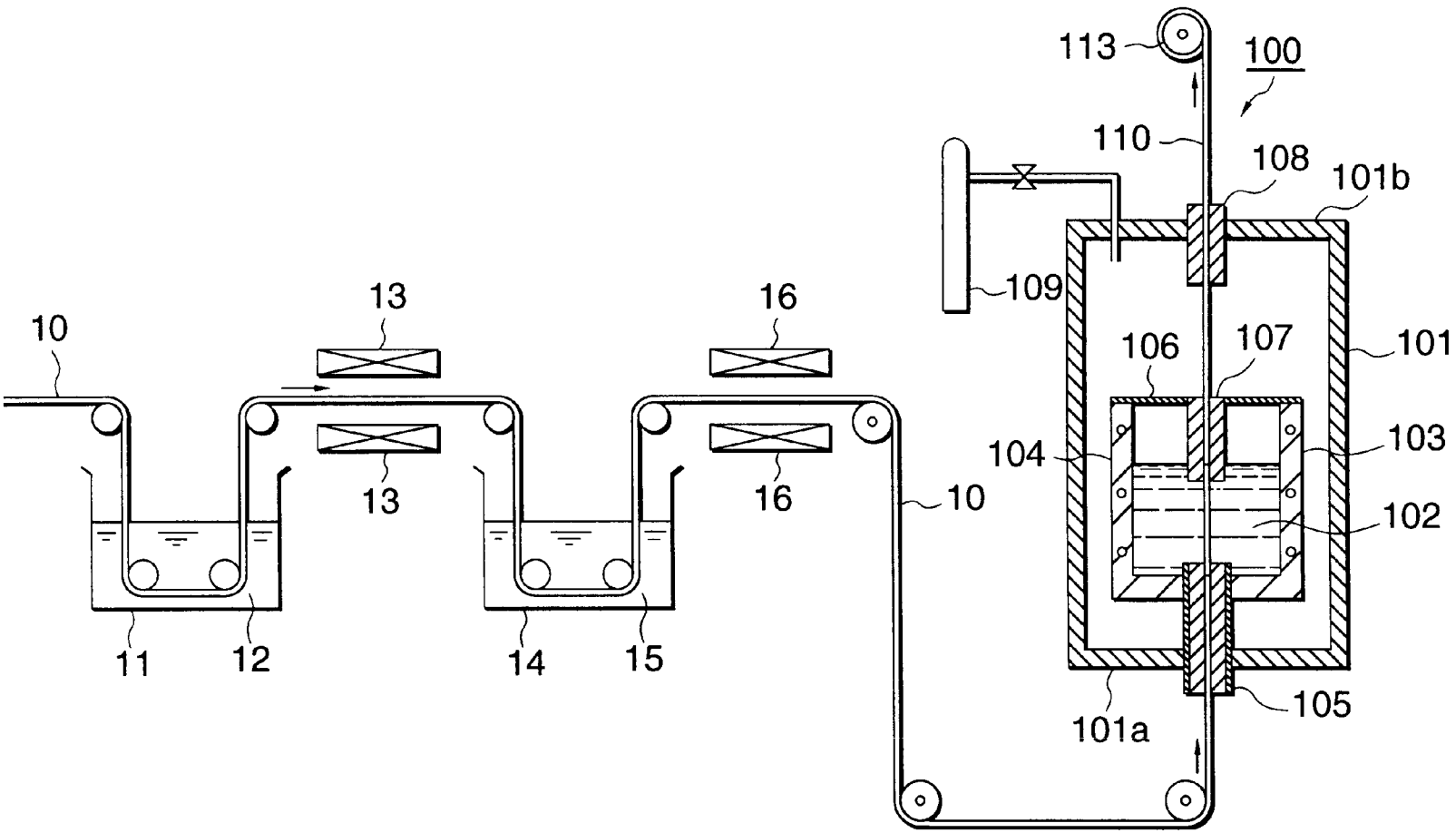

PROCESS FOR FABRICATION OF METAL-CARBON FIBER MATRIX COMPOSITE MATERIAL

BACKGROUND OF INVENTION

1. Field of Invention

The present invention relates to a process for the fabrication of a composite of carbon fiber with metal.

2. Related Art

At present, for the purpose of reducing the weight or improving the mechanical properties, a so-called "metal-carbon fiber matrix composite material" obtained by complexing carbon fibers with a metal has been used in many industrial arts. This metal-carbon fiber matrix composite material has heretofore been prepared, e.g., by blowing metal particles onto a bundle of carbon fibers, vacuum-evaporating a metal onto a bundle of carbon fibers or infiltrating a bundle of carbon fibers with a molten metal.

However, the method involving the blowing of metal particles is disadvantageous in that the metal particles cannot penetrate deep into the bundle of carbon fibers, making it possible to provide a sufficient retention of metal and hence obtain a metalcarbon fiber matrix composite material having satisfactory mechanical properties. Further, the method involving the attachment of metal vapor or infiltration of a molten metal is disadvantageous in that since the carbon fibers exhibit a low wettability with a metal, the adhesion between the metal and the carbon fibers is poor, making it difficult for the metal to be introduced deep into the bundle of carbon fibers and retained therein. Moreover, a bundle of carbon fibers normally has fibers bundled with a sizing agent. This sizing agent renders the carbon fibers even less wettable with a metal. It has been occasionally practiced to remove the sizing agent from the bundle of carbon fibers before the contact with the metal. However, the bundle of carbon fibers which has thus been freed of sizing agent has its carbon fibers dissociated and thus can clog the orifice of an infiltration apparatus for infiltrating the bundle of carbon fibers with a molten metal, causing the suspension of production line.

As mentioned above, the foregoing various methods, i.e., method involving the blowing of metal particles, method involving the attachment of metal vapor or infiltration of a molten metal can hardly introduce a metal deep into the bundle of carbon fibers and retain the metal therein due to the low wettability of carbon fibers with a metal and the presence of a sizing agent in the bundle of carbon fibers.

SUMMARY OF INVENTION

The present invention has been worked out in the light of circumstances. An object of the invention is to provide a process for the preparation of a metal-carbon fiber matrix composite material having a great retention of metal which comprises enhancing the wettability of an inorganic fiber with a metal using a simple and easy method so that the metal can be introduced into the depths of the bundle of inorganic fibers.

In order to accomplish the foregoing object, the present invention provides a process for the preparation of a metal-carbon fiber matrix composite material which comprises removing a sizing agent from a bundle of carbon fibers, dipping the bundle of carbon fibers sequentially in an alkoxide solution and an alcohol, and then infiltrating the bundle of carbon fibers with a molten metal.

In the foregoing process, the infiltration of a molten metal is preferably carried out by continuously passing the bundle of carbon fibers which has been dipped in an alcohol through a molten metal charged in a bath container provided with orifices for introducing and discharging the bundle of carbon fibers received in a pressure container.

BRIEF DESCRIPTION OF DRAWINGS

The figure is a schematic diagram illustrating an embodiment of the apparatus suitable for the infiltration of the preparation process of the invention.

DETAILED DESCRIPTION OF THE PREFERRED EMBODIMENTS

The present invention will be further described in connection with the attached drawings.

The figure is a schematic diagram illustrating an embodiment of the producing apparatus suitable for the infiltration of the process according to the invention. As shown in the figure, a bundle of carbon fibers 10 which has been previously freed of sizing agent is firstly dipped in an alkoxide solution 12 in a bath container 11. The method for removing a sizing agent is not specifically limited. The removal of a sizing agent can be accomplished by any known method. For example, by heating the bundle of carbon fibers to a temperature of about 800° C. in an atmosphere of argon, a sizing agent can be removed from the bundle of carbon fibers 10 even in the interfiber spacing. As such an alkoxide solution there may be preferably used a silicon-based or titanium-based alkoxide solution or the like. The concentration of the alkoxide solution 12 is preferably from 2 to 20% by weight.

Once freed of sizing agent, the bundle of carbon fibers 10 dissociate into fibers. The alkoxide solution 12 penetrates sufficiently into the gap between the fibers and deep into the bundle of carbon fibers 10 to form a film of alkoxide solution 12 on the most of the carbon fibers constituting the bundle of carbon fibers 10. An alkoxide acts to enhance the wettability of carbon fibers. Thus, the alkoxide solution 12 is dried to allow the alkoxide component in the solution to be attached to the various carbon fibers constituting the bundle of carbon fibers 10. Drying may be carried out by allowing the bundle of carbon fibers 10 which has been dipped in the alkoxide solution 12 to run over a sufficient distance. In order to reduce the production line, however, it is preferred that drying be forcedly carried out by passing the bundle of carbon fibers 10 through a heater 13.

Unless otherwise treated, the bundle of carbon fibers 10 to which an alkoxide component has been attached can be kept loose, causing some troubles such as clogging of the orifice during the subsequent infiltration of a molten metal. In order to avoid these troubles, the bundle of carbon fibers 10 is then dipped in an alcohol 15 in a bath container 14. The alcohol 15 acts to recombine the carbon fibers which have been dissociated. Since the various carbon fibers constituting the bundle of carbon fibers 10 has had an alkoxide component attached thereto to enhance wettability, the alcohol 15 can easily penetrate into the gap between the carbon fibers to realize good bundling. As the alcohol 15 there may be preferably used methanol, ethanol or propanol because it is inexpensive and highly volatile. The alcohol 15 is properly selected depending on the kind of the alkoxide used to render the carbon fibers wettable.

Subsequently, the bundle of carbon fibers 10 is dried to remove the alcohol 15, and then subjected to infiltration of a molten metal. The removal of the alcohol 15 may be carried out by allowing the bundle of carbon fibers 10 which has been dipped in the alcohol 15 to run over a sufficient distance. In order to reduce the production line, however, it is preferred that drying be forcedly carried out by passing the bundle of carbon fibers 10 through a heater 16.

The infiltration of a molten metal is preferably carried out using a metal infiltration apparatus 100. The metal infiltration apparatus 100 comprises a pressure chamber 101 and a bath container 103 for melting and holding a molten metal 102. The bath container 103 is heated by a heater 104. The bath container 103 comprises an entering orifice 105 for allowing the bundle of carbon fibers 10 to enter into the interior of the bath container 103 and an intermediate orifice 107. The entering orifice 105 is connected to the base of the pressure chamber 101*a* and is adapted to introduce the bundle of carbon fibers 10 into the interior of the bath container 103. The intermediate orifice 107 extends from the point below the liquid level of the molten metal 102 to a cover material 106 covering the opening of the bath container 103. A exit orifice 108 is formed on the top 101*b* of the pressure chamber 101 and is adapted to take the bundle of carbon fibers (metal-carbon fiber matrix composite material) 110 infiltrated with a metal out of the bath container 103. A gas supply source 109 supplies an inert gas such as argon gas and nitrogen gas into the pressure chamber 101 so that the pressure in the pressure chamber 101 and the pressure in the bath container 103 can be kept to a predetermined value during the infiltration of the molten metal 102.

In the metal infiltration apparatus 100 having such an arrangement, the bundle of carbon fibers 10 which has been dipped in an alcohol is continuously introduced into the bath container 103 through the entering orifice 105 so that it comes in contact with the molten metal 102. Since the carbon fibers 10 have been bundled with an alcohol, they cannot clog the entering orifice 105. Further, since the bundle of carbon fibers 10 has been rendered by an alkoxide wettable while the pressure chamber 101 and the bath container 103 have been supplied with an inert gas from the gas supply source 109 so that the interior thereof have been pressured, the molten metal 102 can easily penetrate into the gap between the fibers constituting the bundle of carbon fibers 10.

The bundle of carbon fibers 10 which has been infiltrated with a metal is discharged from the bath container 103 through the intermediate orifice 107, and then discharged from the pressure chamber 101 through the exit orifice 108. During this process, while the bundle 10 is moving through the interior of the pressure chamber 101, the molten metal 102 which has been attached to the surface of the fibers and the molten metal 102 which has penetrated into the gap between the fibers are cooled and partly solidified. Further, the rest of the molten metal 102 is solidified by the time at which the bundle 10 is wound on a take-up bobbin 113.

The metal-carbon fiber matrix composite material 110 which has been obtained through the foregoing sequence of metal infiltrating steps is coated with a metal on the surface thereof and has a metal kept deep in the gap between the fibers constituting the bundle. Thus, the metal-carbon fiber matrix composite material of the invention has keep a metal therein more than the conventional products and hence exhibits excellent mechanical properties.

The kind of the metal to be complexed with the carbon fibers in the invention is not limited but may be selected arbitrarily depending on the purpose and desired properties. The kind of the carbon fiber to be used herein is not limited but may be properly selected from the group consisting of PAN-based carbon fiber and pitch-based carbon fiber.

As mentioned above, in accordance with the present invention, a metal-carbon fiber matrix composite material which has a great retention of metal and thus exhibits excellent mechanical properties can be prepared by a simple and easy method that requires no special apparatus.

What is claimed is:

1. A process for the preparation of a metal-carbon fiber matrix composite material comprising the steps of:

a) removing a sizing agent from a bundle of carbon fibers;

b) providing a first bath containing an alkoxide solution;

c) providing a second bath containing an alcohol;

d) dipping the bundle of carbon fibers in the alkoxide solution;

e) dipping the bundle of carbon fibers in the alcohol, wherein step d) is performed before step e); and f) infiltrating the bundle of carbon fibers with a molten metal, wherein step c) is performed before step e).

2. The process for the preparation of a metal-carbon fiber matrix composite material according to claim 1, wherein the infiltration of a molten metal is carried out by continuously passing the bundle of carbon fibers which has been dipped in the alcohol through a molten metal charged in a bath container provided with orifices for introducing and discharging the bundle of carbon fibers received in a pressure container.

* * * * *